United States Patent [19]

Thompson et al.

[11] 4,008,821

[45] Feb. 22, 1977

[54] NECKED-IN CAN BODY AND APPARATUS FOR MAKING SAME

[75] Inventors: George W. Thompson, Orland Park; John T. Hilgenbrink, Oak Lawn, both of Ill.

[73] Assignee: Continental Can Company, Inc., New York, N.Y.

[22] Filed: Aug. 3, 1972

[21] Appl. No.: 277,609

Related U.S. Application Data

[62] Division of Ser. No. 77,617, Oct. 2, 1970, Pat. No. 3,690,279.

[52] U.S. Cl. ..... 220/67; 220/77

[51] Int. Cl.[2] ..... B65D 7/42

[58] Field of Search ..... 220/76, 77, 66, 67; 113/120 AA

[56] References Cited

UNITED STATES PATENTS

| | | | |
|---|---|---|---|
| 1,542,662 | 6/1925 | Brenzinger | 220/67 |
| 1,912,259 | 5/1933 | Coyle | 220/76 |
| 2,426,550 | 8/1947 | Coyle | 220/76 |
| 2,730,983 | 1/1956 | Campbell, Jr. et al. | 220/76 |
| 2,814,416 | 11/1957 | Campbell, Jr. et al. | 220/77 |
| 3,349,952 | 10/1967 | Bijvoet | 220/67 |
| 3,395,827 | 8/1968 | Latawiec | 220/76 |
| 3,452,694 | 7/1969 | Ratzer | 220/76 |
| 3,698,596 | 10/1973 | Potts | 220/77 |

*Primary Examiner*—William Price
*Assistant Examiner*—Allan N. Shoap
*Attorney, Agent, or Firm*—Diller, Brown, Ramik & Wight

[57] ABSTRACT

This disclosure relates to the formation of a can body having at least one necked-in end portion wherein at least the end portion of the can body is of a lapped construction with a deformable bonding material therein. It is customary to neck-in ends of can bodies utilizing a necking die with a floating center post. The clearance in such die construction takes into consideration the extra thickness of the side seam. It is now proposed to make the clearance between the die ring and the center post such that when the necking in occurs, the side seam will be compressed, thereby assuring side seam end portions of a uniform thickness. It is also proposed to effect a reduction in the thickness of the deformable bonding material which will provide increased seam strength, better creep resistance, and last, but not least, superior double seaming latitude because of uniformity and consistency of dimensions.

8 Claims, 7 Drawing Figures

NECKED-IN CAN BODY AND APPARATUS FOR MAKING SAME

This application is a division of our application Ser. No. 77,617, filed Oct. 2, 1970, entitled Necked-In Can Body and Method and Apparatus for Making Same, now U.S. Pat. No. 3,690,279, issued Sept. 12, 1972.

This invention relates in general to new and useful improvements in necked-in can bodies and more particularly to can bodies wherein at least end portions of the side seams thereof are a lapped construction with a deformable bonding material therein, and wherein the ends of the can bodies are necked-in to a reduced diameter.

Background of the Invention

It is well known in the can making art to neck in ends of can bodies to a reduced diameter. Such can bodies have a two-fold advantage. In the first place, they require a smaller diameter end unit at a saving in cost of material. Secondly, by forming the end units of a smaller diameter, the normally protruding double seam is recessed within the extension of the main diameter of the can body, thus preventing chime or seam ride up between adjacent packaged cans and the resultant fracture of the can bodies adjacent the double seams during handling.

In view of the recent commercialization on a large scale of necked-in can bodies, developments have been made in the construction of necking dies. In accordance with the latest developments in necking dies, the die assembly includes an outer dig ring and an inner center post. The center post is of a diameter to internally size the necked-in end portion of a can body and the die ring has an internal sizing surface of a diameter to cooperate with the center post.

Because the can body is of a greater thickness along the side seam thereof and because it is not feasible to orient the can body during the necking-in operation, the center post is mounted so as to float relative to the die ring.

In past die assembly constructions, the clearance between the center posts and the die ring has been such so as to provide ample space for the end portion of the can body, including the greater thickness side seam portion thereof. As a result, the function of the necking die assembly has been solely one of necking-in the end portion of can bodies.

Summary of the Invention

It is to be understood that in the formation of a double seam between an end unit and a can body end portion difficulties are frequently encountered in maintaining a seal along the side seam portion of the can body. This is due to the greater thickness of the can body along the side seam. It will also be readily apparent that difficulties are experienced in providing a proper double seam when there are variations in thickness in the side seam.

It will also be understood that inasmuch as the can bodies are mass produced, it is virtually impossible to maintain the lapped portion in parallelism and at the same spacing at all times. Therefore, not only will the thickness of the deformable bonding material vary from side seam to side seam, but also the thickness will vary both longitudinally of the side seam and circumferentially thereof.

Inasmuch as a mechanical working of the end portion of the can body takes place during necking-in operation performed thereon, it is proposed to take advantage of this forming operation to also reshape the end portion of the double seam, that is that portion thereof which becomes part of the double seam when an end unit is applied.

In accordance with this invention, in lieu of providing ample clearance between the die ring and the floating center posts of the necking die assembly, it is proposed to maintain rigid controls on this clearance and to make the total clearance between the die ring and the floating center posts equal to three times the thickness of the body material plus the desired thickness of the deformable bonding material. By so constructing the necking die assembly, it will be readily apparent that simultaneous with the necking-in operation, there will be a mechanical working of that portion of the side seam which was acted on by the necking die assembly.

The necking die assembly may be constructed merely to maintain a customary deformable bonding material thickness, but assuring that any abnormal thickness will be eliminated by deforming the bonding material. On the other hand, it has been found advantageous to reduce the thickness of the bonding material below that which is customary.

Another feature of this invention is that while the invention is readily adaptable to can body side seams of a lapped construction throughout, it is also particularly adaptable to side seams of the lock and lap type where only the end portions of the side seam are of a lapped construction. In accordance with this invention, it is also proposed to increase the length of the lap portions of such side seams so as to greatly facilitate the necking-in operation and the formation of the necessary double seam.

With the above and other objects in view that will hereinafter appear, the nature of the invention will be more clearly understood by reference to the following detailed description, the appended claims and the several views illustrated in the accompanying drawing:

IN THE DRAWING

FIG. 6 is a sectional view through a necking die assembly and shows a can body of the type illustrated in FIG. 5 having an end portion thereof necked-in.

Figure 1:
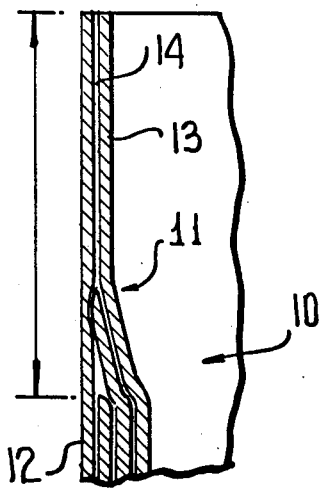
FIG. 1 is a fragmentary sectional view of a customary can body of the type having a lock and lap side seam.

Referring now to the drawings in detail, it will be seen that there is illustrated in FIG. 1 in greatly exaggerated detail a conventional can body construction, the can body being identified by the numeral 10. The can body 10 is formed of a single sheet of metal which is rolled into a cylindrical shape and which has the edges thereof joined together in a side seam, generally identified by the numeral 11. The side seam 11 is of the customary lock and lap type. In the formation of the side seam 11, central portions of the opposite edges of the blank from which the can body 10 is formed, are provided with hooks which are locked together and flattened. As a result, the lock portion of the side seam 11, which lock portion is identified by the numeral 12, is of a four sheet thickness.

Figure 2:
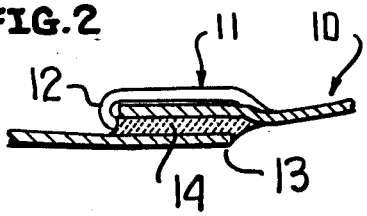
FIG. 2 is a transverse sectional view taken through the lap portion of the side seam and shows exaggerated the existence of deformable bonding material therein.

It has been long recognized that it is impractical to attempt to form a conventional double seam between an end unit and the can body if the side seam is of a four sheet thickness throughout the length thereof. Accordingly, the side seam is provided at the ends thereof with a lap portion identified by the numeral 13. The lap portion 13 is of a two sheet thickness with the laps thereof being bonded together by an intermediate bonding material 14. This bonding material is normally solder and the solder is also incorporated in the lock portion 12. It is also feasible that the bonding material may be in the form of a suitable adhesive or settable compound. With particular reference to FIG. 2, which is exaggerated, it will be readily apparent that it is difficult to maintain control over the thickness of the bonding material 14. On the other hand, it is desirable for numerous reasons to maintain the bonded material 14 as thin as possible. This will be discussed further hereinafter.

Figure 3:
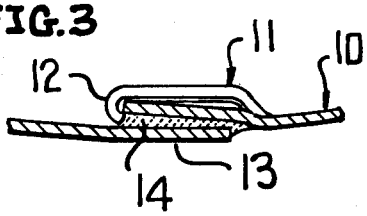
FIG. 3 is a sectional view similar to FIG. 2 and shows the lap portion of a side seam wherein there has been an undesired displacement of one of the laps.
Figure 4:
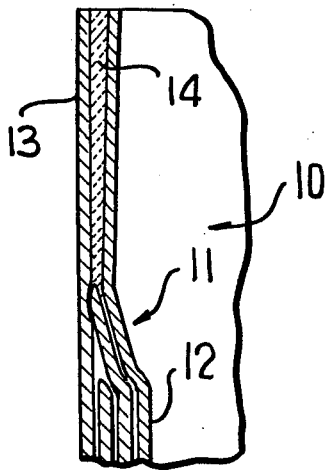
FIG. 4 is a sectional view similar to FIG. 1 and showing in exaggeration a side seam where there has been a displacement of one of the laps.

Referring next to FIG. 3, it will be apparent that with the can bodies 10 being automatically produced at a very high rate, it is not always possible to maintain the laps of the lap portion 13 in exact parallel relation with the result that the thickness of the bonding material 14 is not always uniform in a circumferential direction as is shown in FIG. 3. In a like manner, with reference to FIG. 4, it is also possible that the spacing between the laps of the lap portion 13 may vary longitudinally of the side seam 11 with the result that the thickness of the bonding material 14 may vary longitudinally of the side seam 11.

It is to be understood that an end unit is to be double seamed to a can body, the seaming rolls must be set to take into consideration the thickness of the metal of the can body, including the thickness of the lap portion 13 of the side seam. Thus, it will be readily apparent that any non-uniformity in the lap portion of the side seam will present difficulties in forming a tight double seam. In accordance with this invention, it is proposed to utilize the necking die assembly to shape up the lap portion 13 of the can body which is being necked in so as to assure uniformity of side seam thickness in the area of the double seaming.

Figure 7:
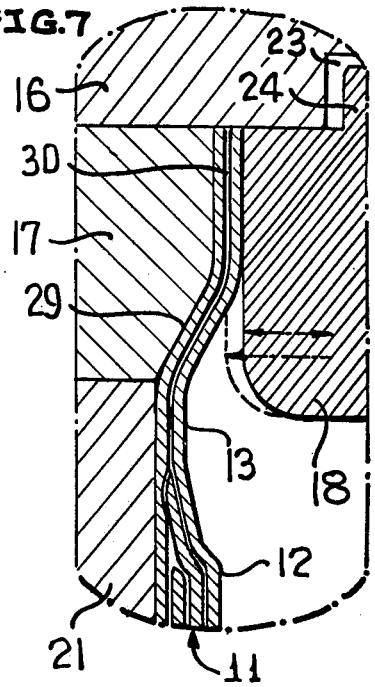
FIG. 7 is an enlargement of a portion of FIG. 6 and shows specifically the details of the die assembly and the relationship thereof to a lapped end portion of the can body side seam.
Figure 6:
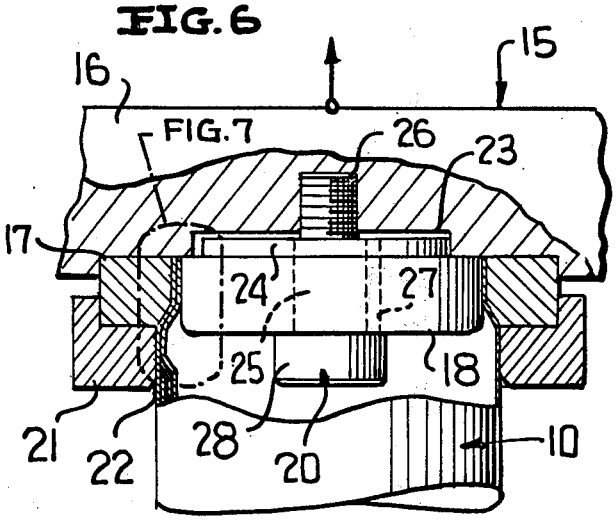

With reference to FIGS. 6 and 7, it will be seen that there is illustrated a necking die assembly for necking in the end of a can body 10, the necking die assembly being generally identified by the numeral 15. The die assembly 15 is carried by a suitable support 16 which may be the head of a press. It is to be understood that the supports 16 may be mounted for reciprocable movement so as to effect the necessary necking-in operation on the can body 10.

The die assembly 15 basically includes a die ring or ring member 17 which is suitably fixedly secured to the underside of the support 16, and a die post or post member 18 which is disposed generally in concentric relation with respect to the die ring 17, but which is floatingly mounted for radial shifting movement relative to both the support 16 and the die ring 17. The post 18 is secured to the support 16 by means of a bolt 20.

The die ring 17 has secured thereto in a conventional manner a separate guide ring 21. The guide ring 21 is provided with a primary bore therethrough for effectively guiding an end portion of a cylindrical member, such as the can body 10, into engagement with the die ring 17 and the post 18 and provides support to prevent buckling of the side wall of a can body during a necking-in operation. The guide ring 21 is also provided with a tapered entrance bore 22 for centering the can body 10 relative to the primary bore thereof.

The underside of the support 16 is provided with a central socket 23 which has received therein a circular cross sectional projection 24 formed at the upper end of the post 18. It is to be noted, however, that the diameter of the projection 24 is less than the diameter of the socket 23 so as to permit limited radial floating or shifting of the post 18 relative to the support 16. It is preferred that the differential in diameters of the socket 23 and the projection 24 be substantially equal to the increased wall thickness of the lap portion 13. This permits the shifting of the post 18 relative to the die ring 17 in accordance with the position of the increased wall thickness of the can body while at the same time assuring the relative central position of the post 18 to facilitate the reception of the post 18 within the end portion of the can body.

At this time it is pointed out that the bolt 20 includes a shank 25 having a threaded end portion 26 which is threaded into the support 16. The shank 25 is received in a central bore 27 formed in the post 18 with there being sufficient clearance between the bore 27 and the shank 25 to permit the necessary floating movement of the post 18. The bolt 20 also includes an enlarged head 28 which is engaged against the underside of the post 18 and eliminates excessive end float and possible cocking of the post 18.

In view of the fact that the die assembly 15 is a necking-in die, the forming surface of the die assembly 15 is on the die ring 17 with the forming surface being identified by the numeral 29. As the end portion of the can body 10 is guided by the guide ring 21 into the die assembly 15, the extreme end thereof engages the tapered forming surface 29 and compresses the end portion of the can body inwardly and forces the same into the space between the die ring 17 and the post 18 with the material of the can body being sufficiently worked so as to permanently deform the same to form on the can body 10 an end portion 30 reduced diameter.

In the past it has been recognized that sufficient clearance must be provided between the post and the die ring to accommodate not only the normal wall thickness of the can body, but also the added thickness of the side seam. Thus, the post 18 functions as an internal sizing die for the necked-in end portion 30 of the can body and the internal surface of the die ring 17 generally functions as an external sizing die although sufficient clearance is provided to assure against jamming of the necked-in end portion 30 between the post 18 and the die ring 17.

In accordance with this invention, it is proposed to utilize the die assembly 15 not only for the purpose of necking in an end portion of the can body, but also for the purpose of sizing or making uniform that portion of the side seam 11 which is incorporated in the necked-in end portion 30. This is accomplished by maintaining a critical relationship between the diameter of the posts 18 and the die ring 17. If it is desired merely to assure uniformity in the thickness of the side seam, the internal diameter of the die ring 17 will be equal to the external diameter of the post 18 plus three times the can body wall thickness plus the normal thickness of the bonding material 14. When the die assembly 15 is so dimensioned, irregularities in the thickness of the bonding material of the type shown in FIGS. 3 and 4 will be overcome and the side seam will be of a uniform thickness both axially and circumferentially throughout the necked in end portion 30. Since this is the portion of the can body which becomes part of the double seam between the can body and the end unit, this provides for a uniform side seam thickness for which the double seaming rolls may be adjusted.

While it may be desired only to assure uniformity of the thickness of the side seam, in accordance with this invention it is further proposed that in lieu of incorporating in the spacing between the post member 18 and the die ring 17 the customary thickness of the bonding material 14, the spacing allotted to the bonding material will be reduced so that in each and every necking-in operation, there will be a compressing of the bonding material with the bonding material flowing generally circumferentially and the thickness thereof reduced. By reducing the thickness of the bonding material, in addition to assuring uniformity of side seam thickness, there is an increase in lap strength and the side seam had better creep resistance. Accordingly, it is proposed in accordance with this invention to so relatively dimension the post member 18 and the die ring 17 so as to assure a reduction in the thickness of the bonding material 14 between the two laps.

Figure 5:
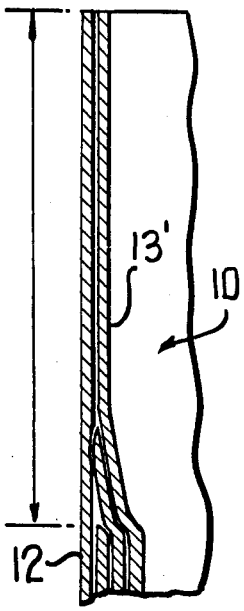
FIG. 5 is a sectional view similar to FIG. 1 and shows a can body constructed in accordance with this invention.

In accordance with this invention, it is also proposed to increase the length of the lap portion as shown in FIG. 5 with the lap portion being identified by the numeral 13:. It has been found that by increasing the lap portion, the resistance to the necking-in operation by the stiffer lock portion 12 is reduced and the can body may be more readily necked-in in the manner shown in FIGS. 6 and 7.

Although in the illustrated embodiment of the invention reference has been made to necking-in only one end of the can body 10, it is to be understood that if desired, both ends may be necked-in. It is also to be understood that while only a side seam of the lock and lap type have been illustrated, the principles of this invention apply equally as well as to a can body wherein the side seam is solely of a lapped construction. It is further to be understood that the invention is not restricted to any specific deformable bonding material 14 although normally the bonding material 14 will generally be solder and in certain instances, an adhesive or settable compound. It is also feasible that the bondable material may be in the form of a plastic strip.

Although only a preferred embodiment of the invention has been specifically illustrated and described herein, it is to be understood that minor variations may be made therein without departing from the spirit and scope of the invention, as defined by the appended claims.

We claim:

1. A can body having a side seam and at least one necked-in end portion, said side seam being of a lapped construction at least along said necked-in end portion and including a deformable bonding material, and the thickness of said side seam along said necked-in end portion being uniform when viewed in both axial and transverse section.

2. The can body of claim 1 wherein said deformable bonding material is in a mechanically compressed state and of a thickness less than the original thickness of such bonding material.

3. The can body of claim 1 wherein said side seam is of the lap and lock type and only end portions of said side seam are of a lapped construction.

4. The can body of claim 3 wherein all of the lock portion of said side seam is in the original diameter portion of said can body.

5. A substantially tubular metal can body comprising a substantially cylindrical central section and at least one necked-in terminal section, said necked-in terminal section having an annular portion providing an abrupt and substantial reduction in diameter of said tubular can body, said tubular can body further including a side seam extending along said tubular body including said necked-in section, said side seam including a soldered interlocking portion extending along said cylindrical central section and at least one lap portion extending throughout said at least one necked-in terminal section and into said cylindrical central section, said necked-in terminal section being of an external diameter substantially less than the external diameter of said cylindrical central section whereby a can end double seamed to said necked-in terminal section including the normal protruding double seam will be recessed within an axial projection of said cylindrical central section, said lap portion extending along the surface of said annular portion so as to extend substantially radially and axially beyond said necked-in terminal section.

6. The can body of claim 1 wherein the solder of said necked-in terminal section is of a uniform thickness.

7. The can body of claim 6 wherein said solder is in a mechanically compressed state and of a thickness less than the original thickness of such solder.

8. The can body of claim 5 wherein all of the interlocking portion of said side seam is in the original diameter portion of said can body.

* * * * *